US007394007B2

(12) United States Patent
Keefe et al.

(10) Patent No.: US 7,394,007 B2
(45) Date of Patent: Jul. 1, 2008

(54) CONICAL PICCOLO

(76) Inventors: James J. Keefe, 54 Church St., Winchester, MA (US) 01890; Janet D. Kinmonth, 33 Page Brook Rd., Carlisle, MA (US) 01741

( * ) Notice: Subject to any disclaimer, the term of this patent is extended or adjusted under 35 U.S.C. 154(b) by 0 days.

(21) Appl. No.: 11/501,344

(22) Filed: Aug. 9, 2006

(65) Prior Publication Data

US 2008/0034943 A1 Feb. 14, 2008

(51) Int. Cl.
*G10D 7/04* (2006.01)

(52) U.S. Cl. ..... 84/385; 84/380 R

(58) Field of Classification Search ..... 84/380 A, 84/386, 381, 385 P, 380 R, 385 A
See application file for complete search history.

(56) References Cited

U.S. PATENT DOCUMENTS 5,038,656 A * 8/1991 Anderson ..... 84/380 R

* cited by examiner

*Primary Examiner*—Kimberly Lockett
(74) *Attorney, Agent, or Firm*—Lambert & Associates; Gary E. Lambert; Adam J. Bruno

(57) ABSTRACT

The subject invention is an improved conical piccolo that has a new fingering mechanism and an additional tone hole opening. The improved conical piccolo allows a user to easily play all six standard trills, including the third octave G to A trill. The improved conical piccolo simplifies the fingering required by a user to play the third octave G to A trill.

14 Claims, 12 Drawing Sheets

CONICAL PICCOLO

BACKGROUND OF THE INVENTION

1. Field of Invention

The invention relates generally to the field of conical piccolos and especially of an improved conical piccolo that simplifies the fingering required by a user to play the third octave G to A trill.

2. Description of the Related Art

Almost all modern orchestras and symphonic bands use conical piccolos. Some piccolo players do use the cylindrical piccolos, especially in marching bands, but in orchestras their use is rare.

Conical piccolos, like cylindrical piccolos and flutes, can produce a sound known as trilling. The Harvard Dictionary of Music defines trilling as a musical ornament consisting of the rapid alternation of a given note with a diatonic second above it. (Harvard Dictionary of Music, (1972), 2nd Edition, Willi Apel, Harvard University Press, Cambridge, Mass.). One limitation of the conical piccolo is the difficult and awkward fingering required to create an accurate and in-tune trill between the notes of G and A of the third, or highest, octave (the G/A trill). In the art, fingering is a term meaning a methodical pattern of usage of the fingers in playing an instrument. (Harvard Dictionary of Music, (1972), 2nd Edition, Willi Apel, Harvard University Press, Cambridge, Mass.).

Conical piccolo fingering guides list multiple fingerings for the G/A trill, but all of them are difficult to implement. For example, Williams lists eight possible fingerings for the G/A trill on the conical piccolo. (Williams, Morgan, (December 1997), "Piccolo Trill Fingerings," *Flute Talk*, pp. 31-32). Williams describes these eight fingerings as either awkward, difficult to play, or requiring a user to push in the head joint which means the user must stop playing and adjust the spacing between the head joint and body of the conical piccolo. By using this last method, a user would have to: 1) stop playing the piccolo; 2) adjust the spacing; 3) play the G/A trill; 4) readjust the spacing; and 5) resume playing the piccolo.

Due to the nature of the acoustic difference between the cylindrical flute or cylindrical piccolo and the conical piccolo the third octave G/A trill becomes mechanically problematic. To produce the correct venting for the third octave A note in the G/A trill requires a very awkward fingering wherein the first finger of the left hand goes up, the fourth finger of the left hand goes down and the first finger of the right hand goes down simultaneously and in rapid succession.

Many fingerings of the conical piccolo can be played by adapting the fingerings used on a cylindrical flute. The G/A trill can be played easily on the cylindrical flute. The standard flute fingering for the third octave G/A trill works very well. However, this preferred flute fingering is not even listed in conical piccolo fingering guides because it does not work. While most of the fingerings used on the cylindrical bore flute work well on the conical piccolo, the fingering for the third octave G/A trill does not work.

On the cylindrical flute the third octave G/A trill is made easier for a user by the use of a special key, called the C sharp trill key, which consists of an additional tone hole opening and key. This C sharp trill key simplifies at least six trills on the flute by allowing a user to switch several left hand movements to the right hand. These six trills or standard trills are the first and second octave B to C sharp, the first and second octave C to C sharp, the third octave F sharp to G sharp, the third octave G to A flat, the third octave A flat to B flat and the third octave G to A. One of the trills simplified by this key is the third octave G/A trill. This C sharp trill key provides simpler fingering, improved tone quality, improved tuning of the pitches of the individual notes in the trills, and more dynamic range to the user. The C sharp trill key was patented in France in 1909 by Mme. Cornelie Villedieu Laube. (French patent No. 409, 922).

Adapting the C sharp trill key found on cylindrical flutes to the conical piccolo allows a user to easily play five of the six main trills on the conical piccolo but it does not allow a user to produce the third octave G/A trill. Thus, even with the addition of a C sharp trill key to the conical piccolo, a user must still use an awkward or difficult fingering to produce the third octave G/A trill.

Instead of using the C sharp trill key found on the flute, a few obscure conical piccolos and some, but more commonly, cylindrical flutes have been manufactured with a slightly different trill mechanism, usually called the G-A trill key. This trill key consists of two small tone hole openings: a C sharp tone hole opening and an A tone hole opening controlled by one key. However, the G-A trill key on the conical piccolo produces a third octave G/A trill that is unresponsive and can only be played at the loudest volumes possible and even then, it is very difficult for a user to sustain the sound. This G-A trill key on the conical bore piccolo does not produce a satisfactory third octave G/A trill on the conical piccolo and it is not an option offered by virtually any modern piccolo makers. This G-A trill key is also quite obscure on older conical piccolos.

In summary, the standard cylindrical flute fingering for the G/A trill is effective on the flute but is entirely ineffective on the conical piccolo. In addition, the C sharp trill key allows a user to easily play six main trills, including the G/A trill on a cylindrical flute, but a similar mechanism on a conical piccolo does not allow a user to produce a satisfactory G/A trill. Finally, on rare occasions, a G-A trill key is added to the conical piccolo and only works when played at the loudest volume possible and is therefore unsuitable for orchestral work which requires a versatile range of volume. Thus, no good solution to the problem of playing the third octave G/A trill on the conical piccolo existed before the subject invention.

Allowing users of conical piccolos to easily play the G/A trill is desired since this trill is regularly found in the orchestral repertoire. Several examples of pieces that employ this G/A trill include The Nutcracker Ballet by Tchaikovsky, Symphonic Metamorphosis by Hindemith and Cakewalk Suite by Gottschalk.

The subject invention provides two improvements to currently existing conical piccolos. First, the subject invention provides an improved conical piccolo that allows a user to simply play the G/A trill. Second, this invention provides an improved conical piccolo with a C sharp trill mechanism that allows the user of the piccolo to easily play all six standard trills, including the G/A trill.

BRIEF SUMMARY OF THE INVENTION

The subject invention provides for an improved conical piccolo comprising an additional tone hole opening, an axle, a means for attaching the axle to the conical piccolo, wherein the axle further comprises an external cover of tubing; wherein the tubing rotates around the axle, a trill key attached at a first end to the tubing, a trill key pad attached to a second end of the trill key, a means for applying a first rotational force to the trill key wherein the trill key pad seals the additional tone hole opening, and a means for a user to apply a second rotational force wherein the trill key rotates on the tubing away from the additional tone opening wherein the trill key pad no longer seals the additional tone hole opening.

The invention further provides for an improved conical piccolo comprising an additional tone hole opening, a first post attached to the F sharp post, a second post attached to the upper C sharp post, an axle attached at a first end to the first post and attached at a second end to the second post, wherein the axle further comprises an external cover of tubing, wherein the tubing rotates around the axle, a trill key attached at a first end to the tubing, a trill key pad attached to a second end of the trill key, a trill key tail attached at a first end to the tubing, a trill lever attached at a first end to the tubing proximal to the first post, a spring catch attached to the tubing, a wire spring attached at a first end to the second post and attached at a second end to the spring catch, wherein the wire spring applies rotational force to the trill key and the spring catch in opposing directions wherein the trill key pad seals the additional tone hole opening, wherein depressing a second end of the trill lever rotates the tubing around the axle and opposes the rotational force applied to the trill key wherein the trill key rotates on the tubing away from the additional tone hole opening wherein the trill key pad no longer seals the tone hole opening.

These together with other objects of the invention, along with the various features of novelty which characterize the invention, are pointed out with particularity in the claims annexed to and forming a part of this disclosure. The invention is not limited to the embodiments described herein, thus reference should be made to the accompanying drawings and descriptive matter in which the preferred embodiments of the invention are illustrated.

DETAILED DESCRIPTION OF THE INVENTION

The essence of this invention is to produce the correct venting for each note in the G/A trill on the conical piccolo while not limiting the availability of any of the standard six trills found on the cylindrical flute C sharp trill.

Figure 1:
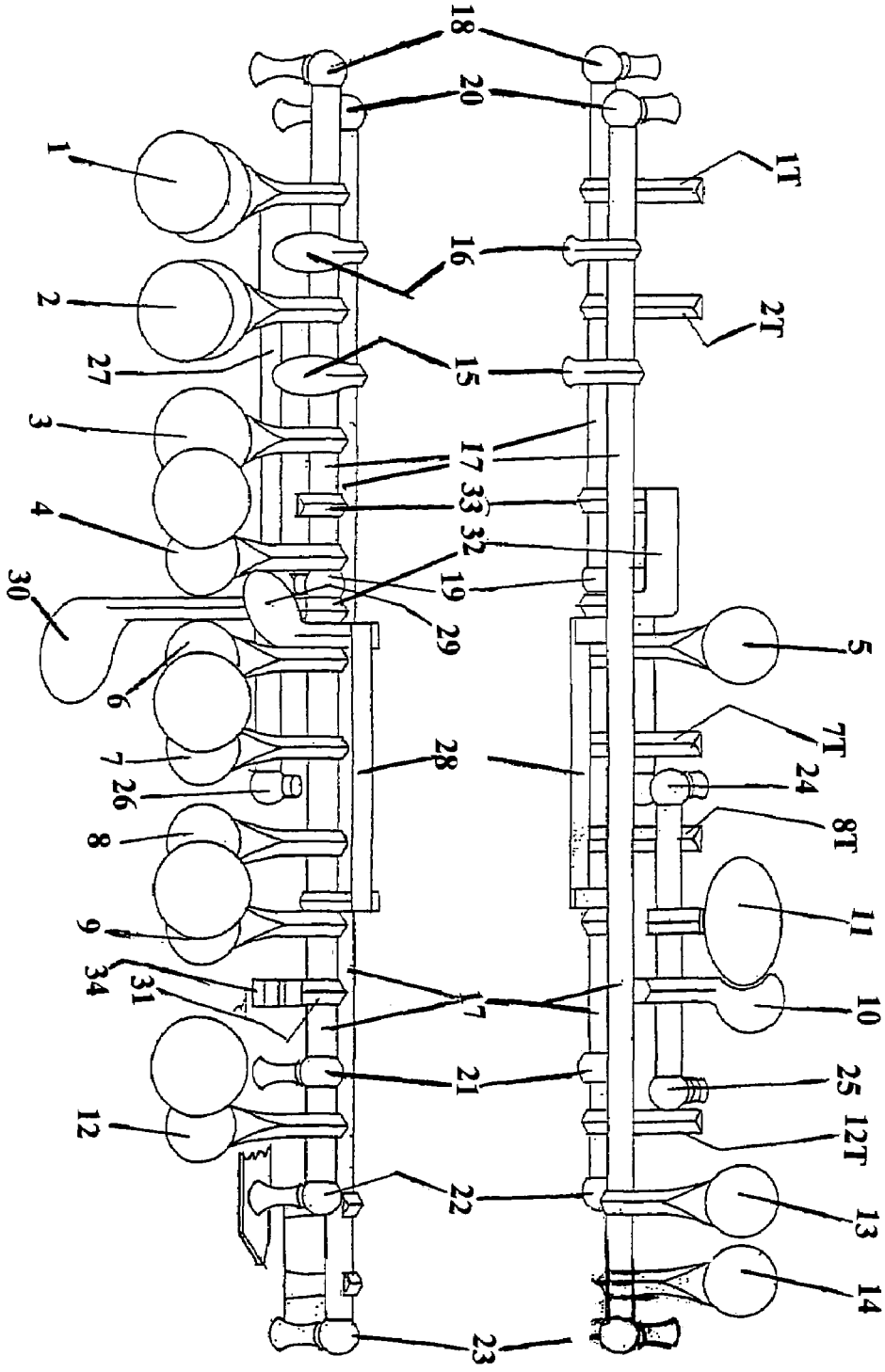
FIG. 1 is a view of the standard conical piccolo mechanism.

FIG. 1 illustrates the standard conical piccolo mechanism built by nearly all modern piccolo and flute makers, known as the Boehm system. The standard conical piccolo mechanism includes a D key 1, a D key tail 1T, an E key 2, an E key tail 2T, an F key 3, an F sharp key 4, a G sharp key 5, a G key—lower cup 6, a G key—upper cup 7, a G key tail 7T, an A key 8, an A key tail 8T, an A sharp key 9, a Thumb B flat key 10, a Thumb B natural key 11, a C sharp key 12, a C sharp key tail 12T, a D trill key 13, a D sharp trill key 14, a D trill lever 15, a D sharp trill lever 16, tubing 17, a D post 18, an F sharp post 19, a Lower trill post 20, a Lower C sharp post 21, an Upper C sharp post 22, an upper trill post 23, a lower thumb post 24, an upper thumb post 25, a G sharp post 26, a Right hand bridge 27, a Left hand bridge 28, a B flat shake 29, a G sharp lever 30, a cam 31, a Left hand back connector 32, a Right hand back connector 33, and a B flat thumb tail 34. The D sharp key, which is also part of the standard conical piccolo mechanism, is not shown. This mechanism does not include the C sharp trill key or a G sharp trill key.

The improved conical piccolo of the subject invention is based upon the Boehm system, but with further improvements. Accordingly, since many variations exist for the production of a Boehm system conical piccolo, the improved conical piccolo of the subject invention incorporates all the embodiments for producing variations of Boehm system conical piccolos known in the art.

For instance, the improved conical piccolo of the subject invention may be pitched in either the key of C, D flat, B Flat or any other key known in the art.

The improved conical piccolo of the subject invention may be a ring key piccolo or an open hole piccolo.

In addition, the improved conical piccolo of the subject invention may be composed of any material known in the art including, but not limited to wood, composite materials such as fiberglass or carbon fiber, plastic, or metals such as gold, silver, platinum, nickel, tin and brass.

The improved conical piccolo of the subject invention may be manufactured by hand, by machine, a combination of both or by any means known in the art.

The keys of the mechanism may be connected by pinning or soldering them to the axles or by attaching them to the axles with set screws. In the alternative, the keys may be connected by soldering them to bridges or metal rods that run parallel to the axles. All of the disclosed figures display keys connected by soldering them to bridges. However, the improved conical piccolo of the subject invention may have the keys pinned or soldered to the axles, or attached to the axles with set screws.

In addition, various types of tubing may be used in the improved conical piccolo of the subject invention, including mechanism tubing and hinge tubing.

The subject invention encompasses an improved conical piccolo that allows a user to easily produce the third octave G/A trill without awkward and impractical fingering.

The subject invention provides for an improved conical piccolo comprising an additional tone hole opening, an axle, a means for attaching the axle to the conical piccolo, wherein the axle further comprises an external cover of tubing; wherein the tubing rotates around the axle, a trill key attached at a first end to the tubing, a trill key pad attached to a second end of the trill key, a means for applying a first rotational force to the trill key wherein the trill key pad seals the additional tone hole opening, and a means for a user to apply a second rotational force wherein the trill key rotates on the tubing away from the additional tone opening wherein the trill key pad no longer seals the additional tone hole opening.

The invention also provides for an improved conical piccolo comprising an additional tone hole opening, a first post attached to the F sharp post, a second post attached to the upper C sharp post, an axle attached at a first end to the first post and attached at a second end to the second post, wherein the axle further comprises an external cover of tubing, wherein the tubing rotates around the axle, a trill key attached at a first end to the tubing, a trill key pad attached to a second end of the trill key, a trill key tail attached at a first end to the tubing, a trill lever attached at a first end to the tubing proximal to the first post, a spring catch attached to the tubing, a wire spring attached at a first end to the second post and attached at a second end to the spring catch, wherein the wire spring applies rotational force to the trill key and the spring catch in opposing directions wherein the trill key pad seals the additional tone hole opening, wherein depressing a second end of the trill lever rotates the tubing around the axle and opposes the rotational force applied to the trill key wherein the trill key rotates on the tubing away from the additional tone hole opening wherein the trill key pad no longer seals the tone hole opening.

The improved conical piccolo may further comprise a trill touch piece mounted on the G sharp lever, wherein depressing the trill touch piece and the trill lever simultaneously unseals the additional tone hole opening and the G sharp key.

The rotational force applied to the trill key in the improved conical piccolo of the subject invention may be applied by any means known in the art. Methods of applying this rotational force may include, but are not limited to needle springs, coil springs, opposing magnets or any other means known in the art.

The invention also provides for a method of using the improved conical piccolo which allows a user to simultaneously vent the C sharp trill tone hole opening, the D trill tone hole opening and the G sharp tone hole opening using the first two fingers of the right hand.

The subject invention encompasses an improved conical piccolo, wherein during a continuous play duration, a user can play all six standard trills of the flute by depressing keys of the piccolo.

The subject invention also encompasses an improved conical piccolo wherein a user can play the third octave, G to A trill by trilling fingers of one hand and in the same direction of motion.

The subject invention also encompasses an improved conical piccolo wherein the third octave G to A trill is improved in clarity, repetition and intonation.

Figure 2:
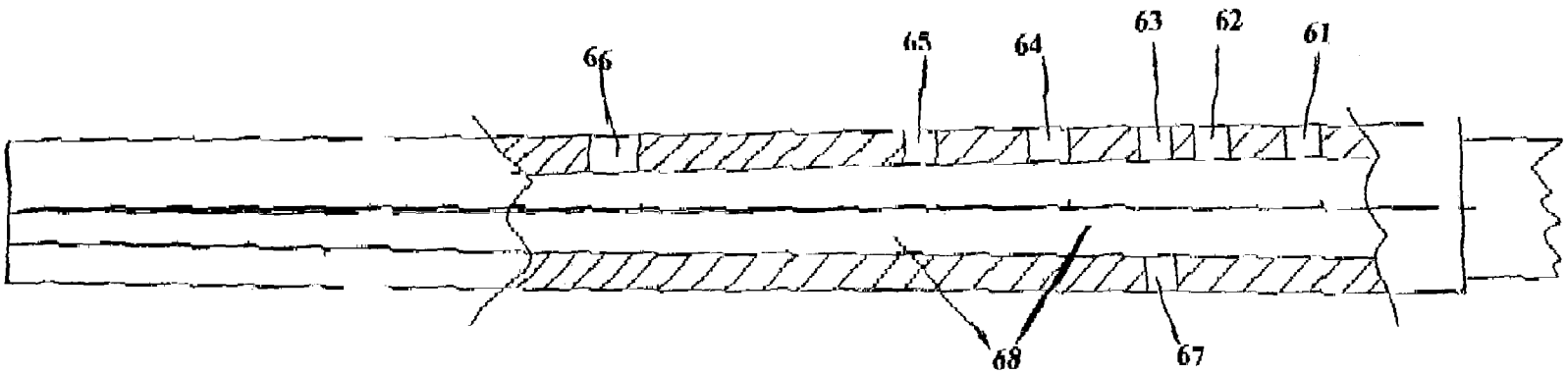
FIG. 2 is a sectional view of a conical piccolo body containing a C sharp trill tone hole opening.
Figure 3:
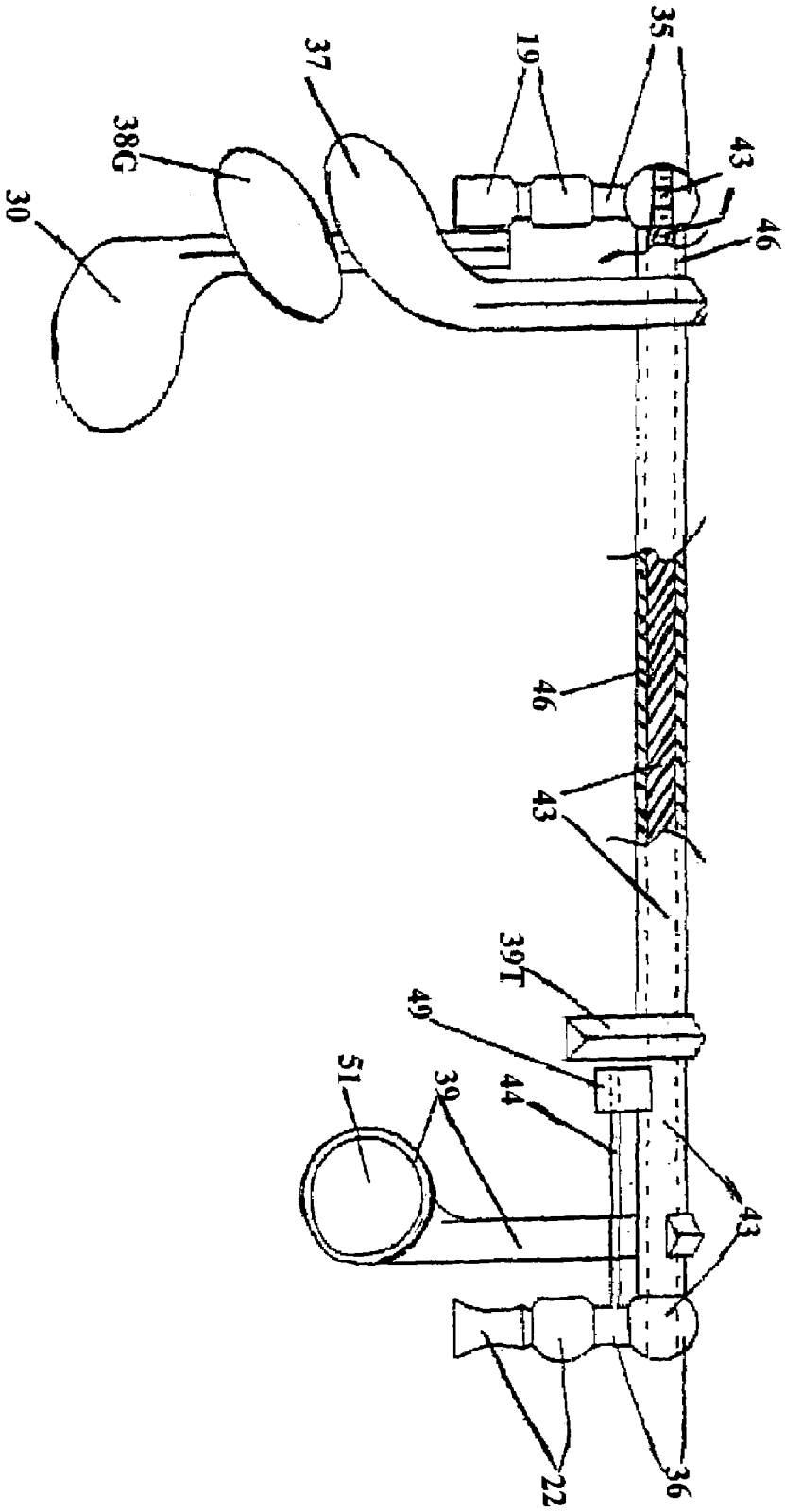
FIG. 3 is a view of a G sharp touch piece and a C sharp trill key which is connected by an axle which is mounted to a conical piccolo mechanism on a conical piccolo on the F sharp post and the upper C sharp post.
Figure 4:
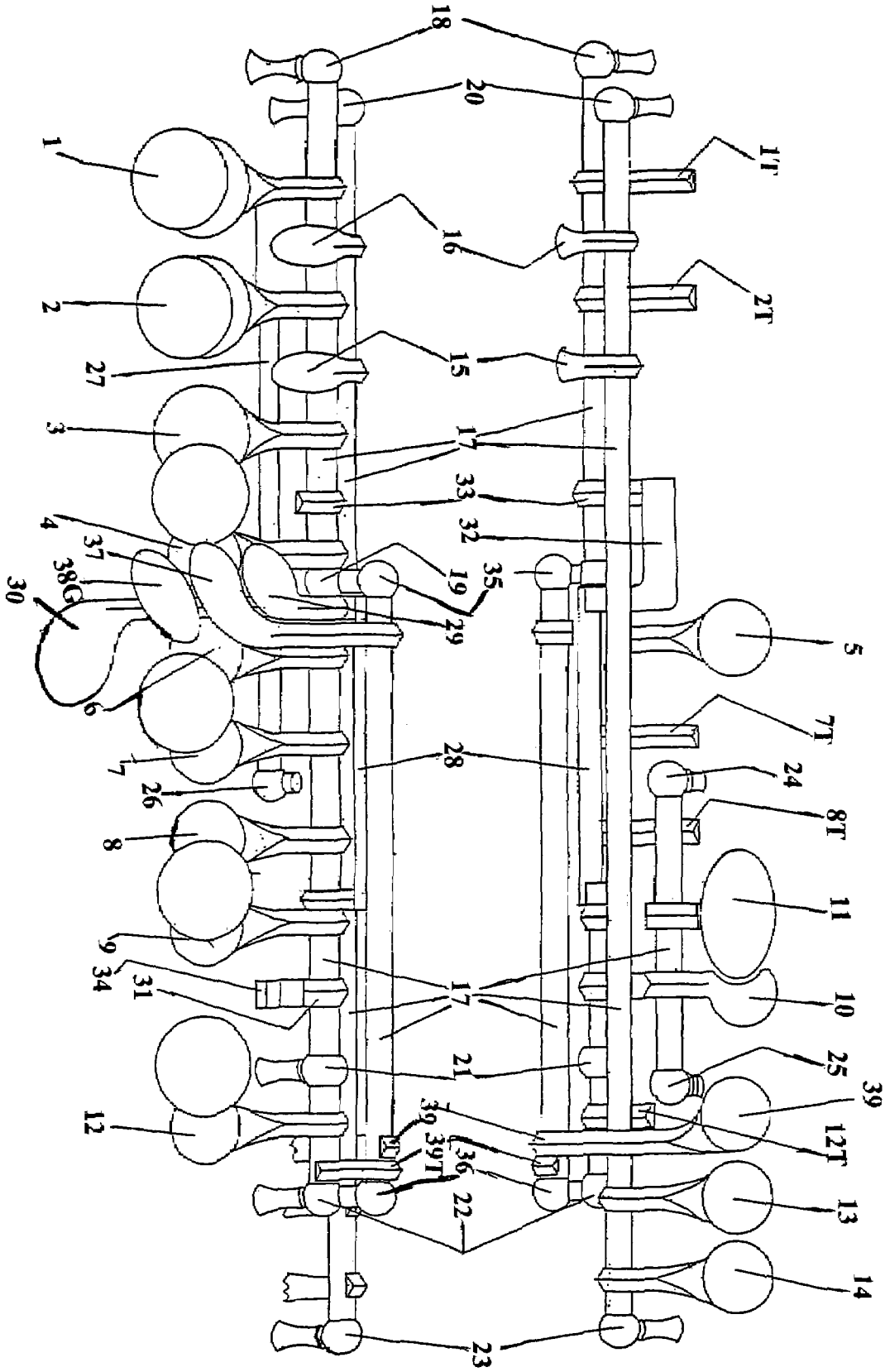
FIG. 4 is a view of a conical piccolo mechanism containing a post mounted C sharp trill key and a G sharp trill touch piece.

FIGS. 2, 3 and 4 illustrate the preferred embodiment of the subject invention. Standard conical piccolos include numerous tone hole openings. FIG. 2 illustrates the sectional view of the improved conical piccolo with an additional tone hole opening. A standard conical piccolo would contain the D sharp trill tone hole opening 61, the D trill tone hole opening 62, the upper thumb tone hole opening 64, the lower thumb tone hole opening 65, the G sharp tone hole opening 66, the main line C sharp tone hole opening 67 and the conical bore 68. The improved piccolo contains the C sharp trill tone hole opening 63. This trill tone hole opening 63 provides part of the acoustic venting required for the third octave G/A trill and the other five standard trills. FIG. 3 shows the lower C sharp trill post 35 which is mounted on the F sharp post 19 found on standard conical piccolos. The upper C sharp trill post 36 is mounted on the upper C sharp post 22 found on standard conical piccolos. The C sharp trill posts 35 and 36 provide the mechanical foundation for the C sharp trill key 39. The C sharp trill post 36 has a hole in order to be fitted with C sharp trill spring 44. The lower C sharp trill post 35 has a threaded hole to accept a threaded rod, axle 43. The upper C sharp trill post 36 has a hole to accept the non-threaded section of axle 43. The C sharp trill key 39 is attached to a pad 51, which seals the C sharp trill tone hole opening 63 when the key is in the at-rest (closed) position. FIG. 3 illustrates the pad 51 on the underside of the C sharp trill key 39; however, pad 51 is not readily visible when the C sharp trill key 39 is mounted on the body of the piccolo. The C sharp trill key tail 39T provides a limit on the rotational motion of the C sharp trill key 39. The C sharp trill key 39, tail 39T and lever 37 are mounted on tubing 46 surrounding axle 43. This tubing rotates around axle 43. The C sharp trill spring 44 mounted in the upper C sharp trill post 36 is a wire spring that applies a rotational force against the C sharp trill key 39. This rotational force is applied directly against the C sharp trill spring catch 49. The C sharp trill spring catch 49 is attached to the tubing 46. The C sharp trill spring 44 keeps the C sharp trill key 39 closed and pad 51 seals off the C sharp trill tone hole opening 63. The C sharp trill lever 37 allows a user to open the C sharp trill key 39 in order to vent the C sharp trill tone hole opening 63. Depressing the C sharp trill lever 37 causes the tubing 46 to rotate around axle 43. The C sharp trill key 39 is raised (opened) by the rotational motion of the tubing 46, thus causing the C sharp trill tone hole opening 63, to vent. Venting the C sharp trill tone hole 63 opening is necessary for the production of the six standard trills. The G sharp trill touch-piece 38G is mounted on the G sharp lever 30. Depressing the G sharp trill touch-piece 38G and the C sharp trill lever 37 simultaneously opens the C sharp trill key 39 and the G sharp key 5 simultaneously. It is necessary to open the C sharp trill key 39 and the G sharp key 5 simultaneously to achieve the G/A trill. However, opening the G sharp key 5 will prevent the production of the G sharp/F sharp trill. For the G sharp/F sharp trill, the C sharp trill key 39 must be used without opening the G sharp key 5. In summary, in this preferred embodiment the C sharp trill lever 37 and G sharp trill touch-piece 38G can be operated independently or together. Independent operation is necessary because the C sharp trill lever 37 alone is required for five of the six standard trills while both the C sharp trill lever 37 and the G sharp trill touch-piece 38G are required for the G/A trill. The G sharp trill touch-piece 38G is prohibited from use during the F sharp/G sharp trill.

An additional benefit of this preferred embodiment is that the independent G sharp trill touch-piece 38G allows a user to more easily play the trill for G to G sharp in the first two octaves. The trill can be played with the first finger right hand rather than the fourth finger of the left hand.

Figure 5:
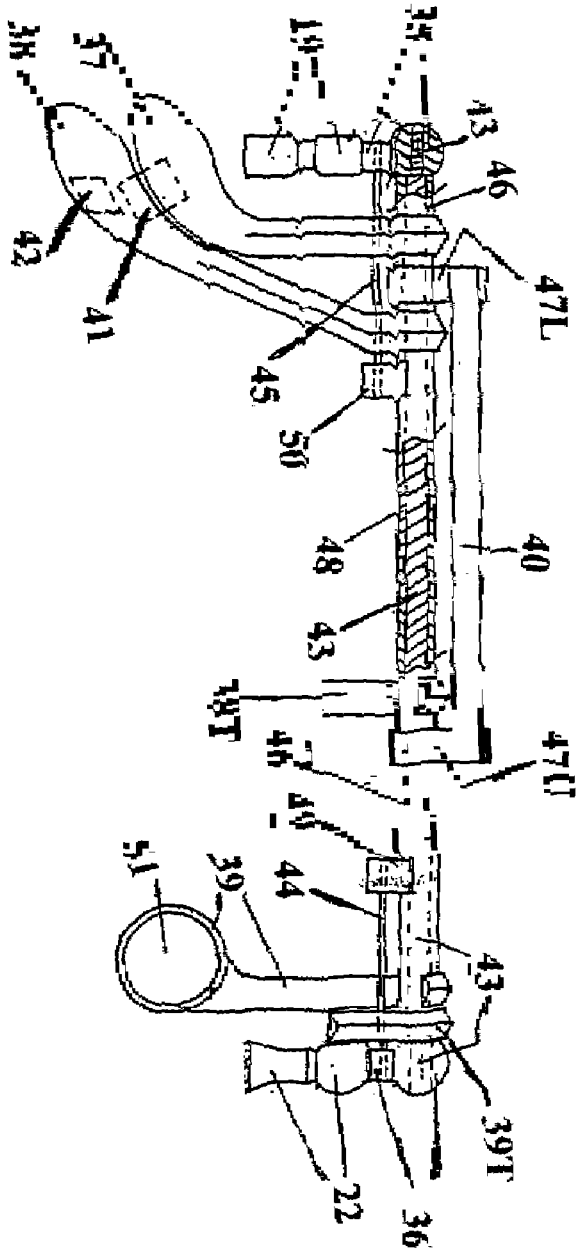
FIG. 5 is a view of a G sharp trill lever and a C sharp trill key which is connected by an axle which is mounted to a conical piccolo mechanism on a conical piccolo on the F sharp post and the upper C sharp post.
Figure 6:
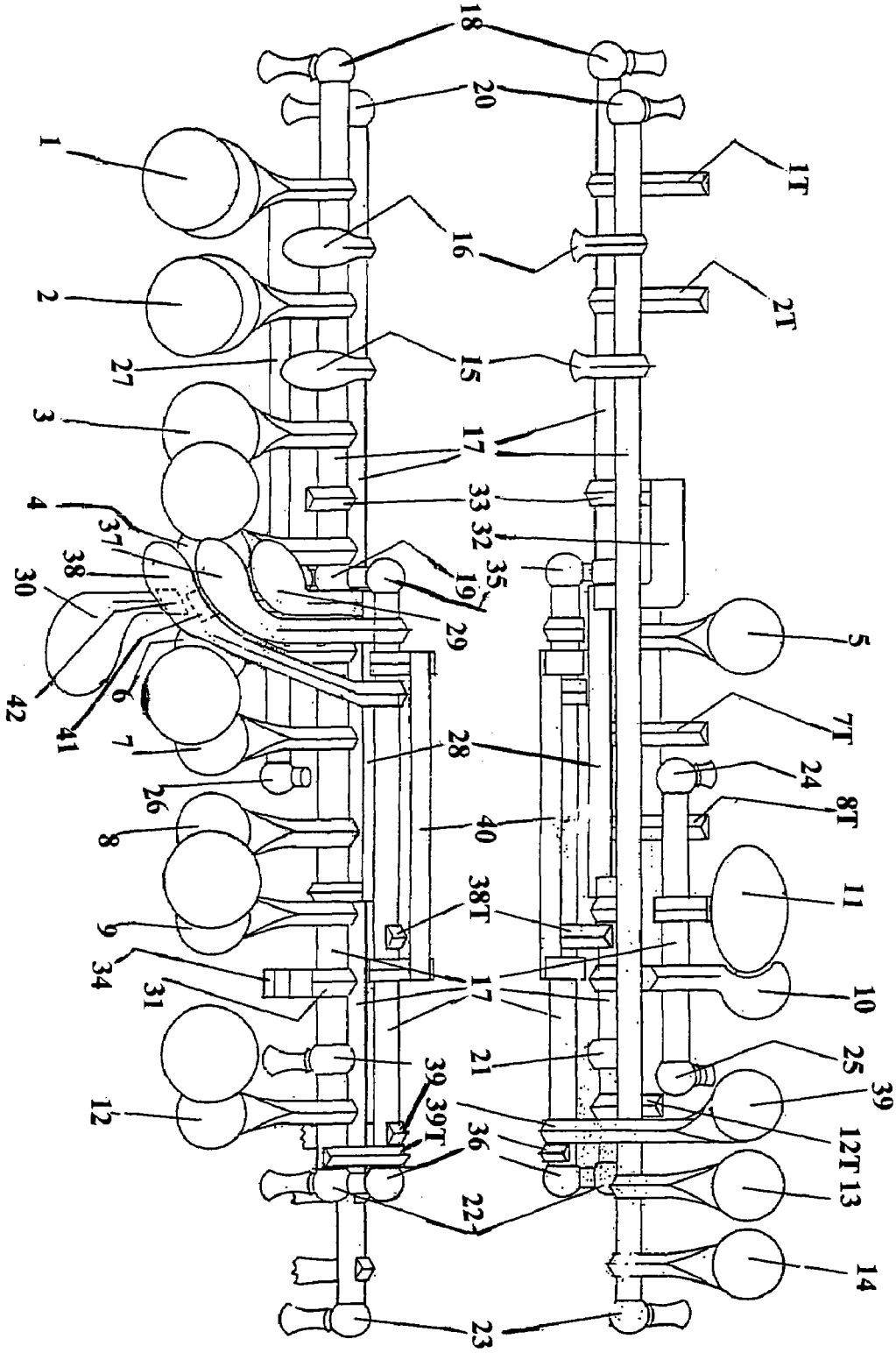
FIG. 6 is a view of a conical piccolo mechanism containing a post mounted C sharp trill key, a G sharp trill lever, a G sharp trill tail, a C sharp trill bridge, a C sharp trill clutch plate, and a G sharp lever underside boss.

FIGS. 2, 5 and 6 illustrate another embodiment of the subject invention. FIG. 2 illustrates the sectional view of the improved conical piccolo with an additional tone hole opening. A standard conical piccolo would contain the D sharp trill tone hole opening 61, the D trill tone hole opening 62, the upper thumb tone hole opening 64, the lower thumb tone hole opening 65, the G sharp tone hole opening 66, the main line C sharp tone hole opening 67 and the conical bore 68. The improved piccolo contains the C sharp trill tone hole opening 63. This trill tone hole opening 63 provides part of the acoustic venting required for the third octave G/A trill and the other five standard trills. FIG. 6 shows the lower C sharp trill post 35 which is mounted on the F sharp post 19 found on standard conical piccolos. The upper C sharp trill post 36 is mounted on the upper C sharp post 22 found on standard conical piccolos. The C sharp trill posts 35 and 36 provide the mechanical foundation for the C sharp trill key 39. The lower C sharp trill post 35 has a threaded hole to accept a threaded rod, axle 43. The upper C sharp trill post 36 has a hole to accept the non-threaded section of axle 43. The C sharp trill key 39 is attached to a pad 51, which seals the C sharp trill tone hole opening 63 when the key is in the at-rest (closed) position. The C sharp trill key tail 39T provides a limit on the rotational motion of the C sharp trill key 39. The C sharp trill key 39, tail 39T and lever 37 are mounted on tubing 46 surrounding axle 43. This tubing 46 rotates around axle 43. The G sharp trill lever 38 and tail 38T are mounted on tubing 48 surrounding axle 43. This tubing 48 rotates around axle 43. The G sharp trill spring 45 is mounted in Lower C sharp trill post 35. The C sharp trill spring 44 is mounted in the upper C sharp trill post 36. These are wire springs that apply a rotational force against the C sharp trill key 39 and the G sharp trill lever 38. The rotational force is applied directly against C sharp trill spring catch 49 and G sharp trill spring catch 50 respectively. The spring catches are attached to the tubing 46 and 48. The C sharp trill spring 44 keeps the C sharp trill key 39 closed and sealing off the C sharp trill tone hole opening 63. The G sharp trill spring 45 raises the G sharp trill lever 38 away form the C sharp trill lever 37. The limit on the rotation of the G sharp trill lever 38 is the G sharp trill tail 38T. The C sharp trill lever 37 allows the player to open C sharp trill key 39 in order to vent the C sharp trill tone hole opening 63. Depressing the C sharp trill lever 37 causes the tubing 46 and the C sharp trill bridge 40 to rotate around the C sharp axle 43. The C sharp trill key 39 is raised (opened) by the rotational motion of the tubing 46, thus causing the C sharp trill tone hole opening 63, to vent. A C sharp trill bridge 40 is a bar that is mounted over a gap in the G sharp trill tubing 48 and is attached to tubing 46 by means of hangers 47L and 47U and provides a means of transferring the motion from the C sharp trill lever 37 to the C sharp trill key 39 while providing space for the G sharp trill tubing 48 to be mounted on the C sharp axle 43. The G sharp trill lever 38 connects with the C sharp trill lever 37 and the G sharp lever 30. By depressing the G sharp trill lever 38, a user is able to open simultaneously the C sharp trill key 39 and the G sharp key 5. It is necessary for the user to open both the C sharp trill key 37 and the G sharp key 5 simultaneously to achieve the G/A trill. However, opening the G sharp key 5 will prevent the production of the G sharp/F sharp trill. For this trill, the C sharp trill key 37 must be used without opening the G sharp key 5. The C sharp trill lever clutch plate 41 is attached to the underside of C sharp trill lever 37 and extends under the G sharp trill lever 38. When the G sharp trill lever 38 is depressed thereby opening the G sharp key 5, it contacts the C sharp trill lever clutch plate 41 and causes the C sharp trill lever 37 to depress. When the G sharp trill lever 38 is depressed, the G sharp lever underside boss 42 attached to the underside of the G sharp trill lever 38 contacts the G sharp trill lever 38 and causes it to depress, thereby opening G sharp key 5.

In summary, the C sharp trill lever 37 can be operated independently or in conjunction with G sharp trill lever 38. This is necessary because the C sharp trill lever 37 alone is required for five of the six standard trills while both the C sharp trill lever 37 and the G sharp trill lever 38 are required for the G/A trill. The G sharp trill lever 38 is prohibited for use during the F sharp/G sharp trill.

Figure 7:
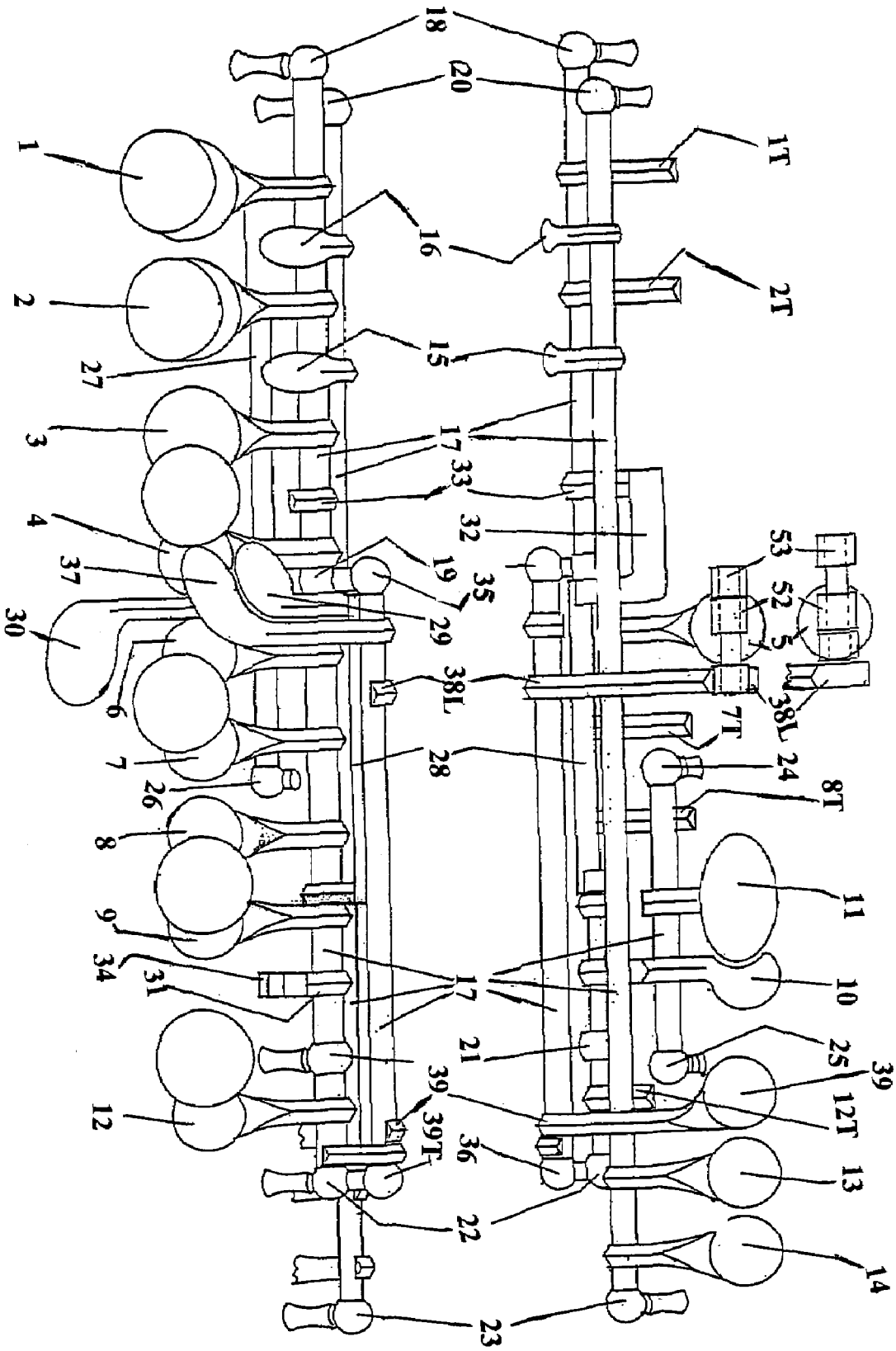
FIG. 7 is a view of a conical piccolo mechanism containing a post mounted C sharp trill key, a G sharp trill link, a G sharp key barrel, and a G sharp key pin.

FIGS. 7, 5 and 2 illustrate another embodiment of the subject invention. In this embodiment the G sharp trill lever 38 of previous embodiments is eliminated and instead a link between the G sharp key 5 and the C sharp trill tubing 46 is added. Using this embodiment, a user would need to couple the G sharp key 5 to the G sharp trill link 38L for the purpose of playing the G/A trill. This would be accomplished by sliding G sharp key pin 53 through G sharp key barrel 52 so that the G sharp key pin 53 contacts G sharp trill link 38L. When the C sharp trill key 39 is depressed, its rotation would cause G sharp trill link 38L to rise which would then in turn open the G sharp key 5. To play the F sharp/G sharp trill, the player would be required to de-couple the G sharp key 5 from the G sharp trill link 38L. This would be accomplished by sliding G sharp key pin 53 through G sharp key barrel 52 so that the G sharp key pin 53 clears the G sharp trill link 38L.

Figure 8:
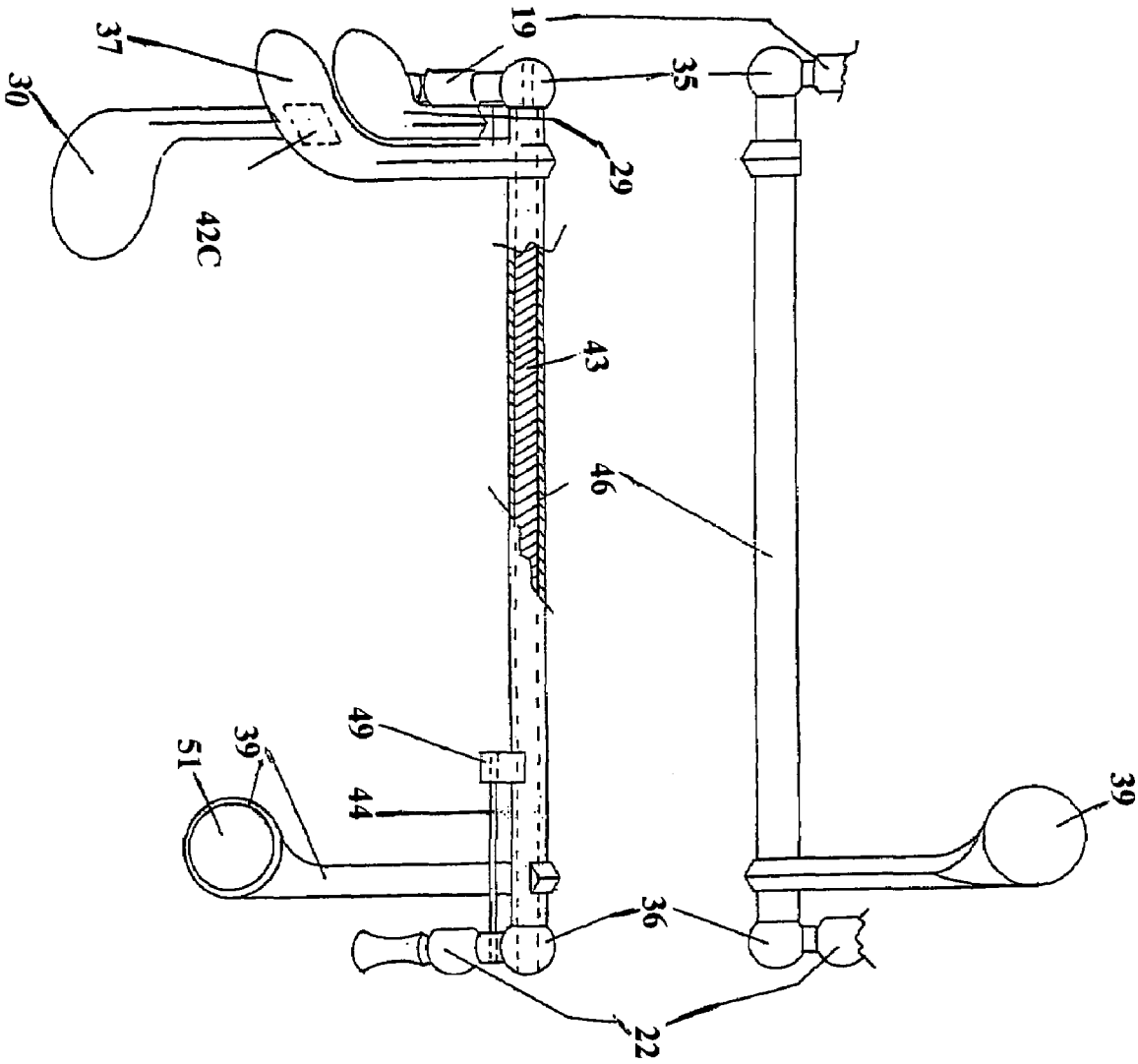
FIG. 8 is a view of a conical piccolo mechanism containing a post mounted C sharp trill key and a C sharp lever underside boss.
Figure 9:
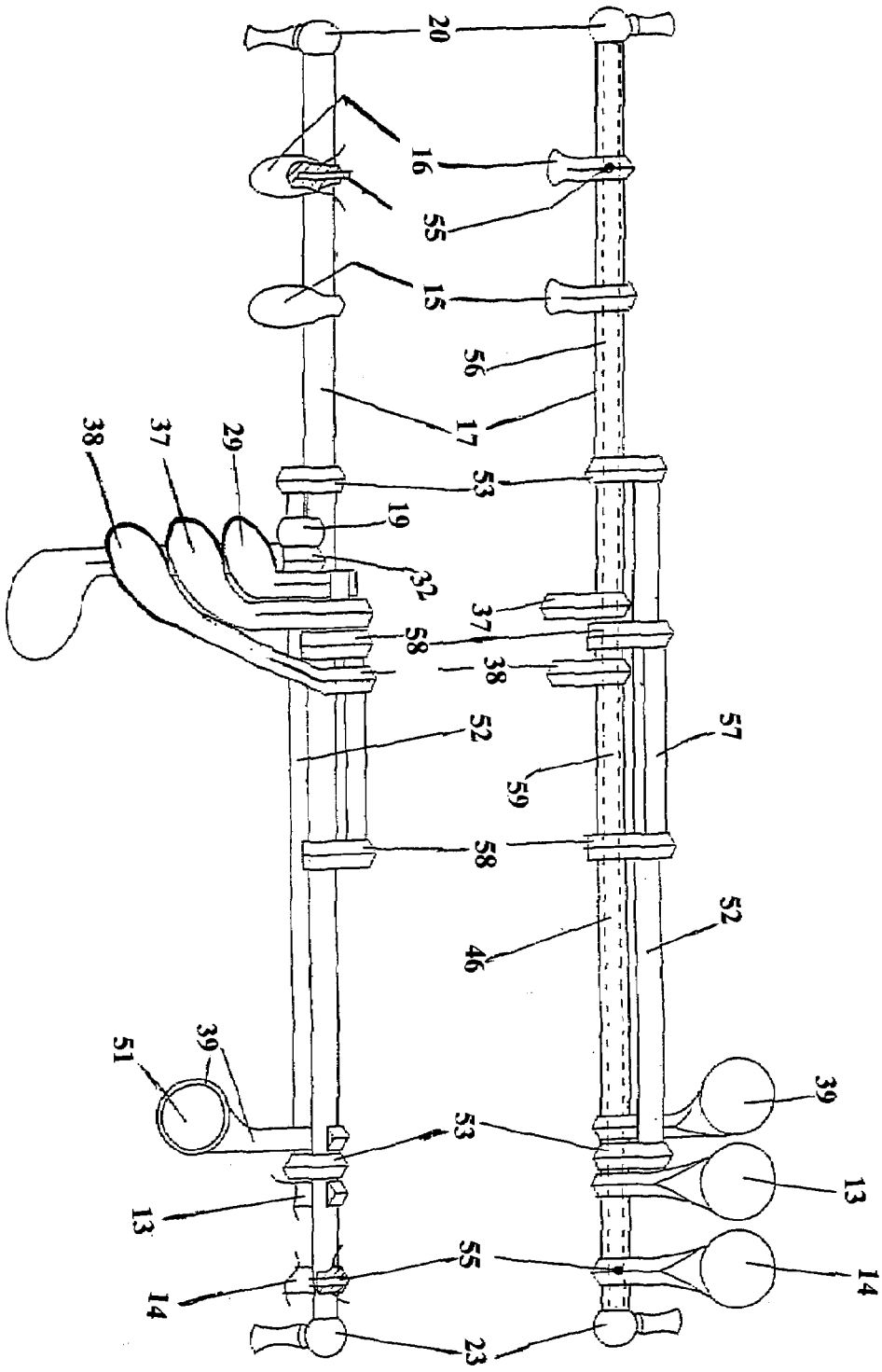
FIG. 9 is a view of a conical piccolo mechanism containing a C sharp trill key mounted on the D and D sharp trill axle further containing a G sharp trill lever, a G sharp trill tail, a C sharp trill bridge, a C sharp trill clutch plate, a G sharp lever underside boss and a C sharp trill bridge.
Figure 10:
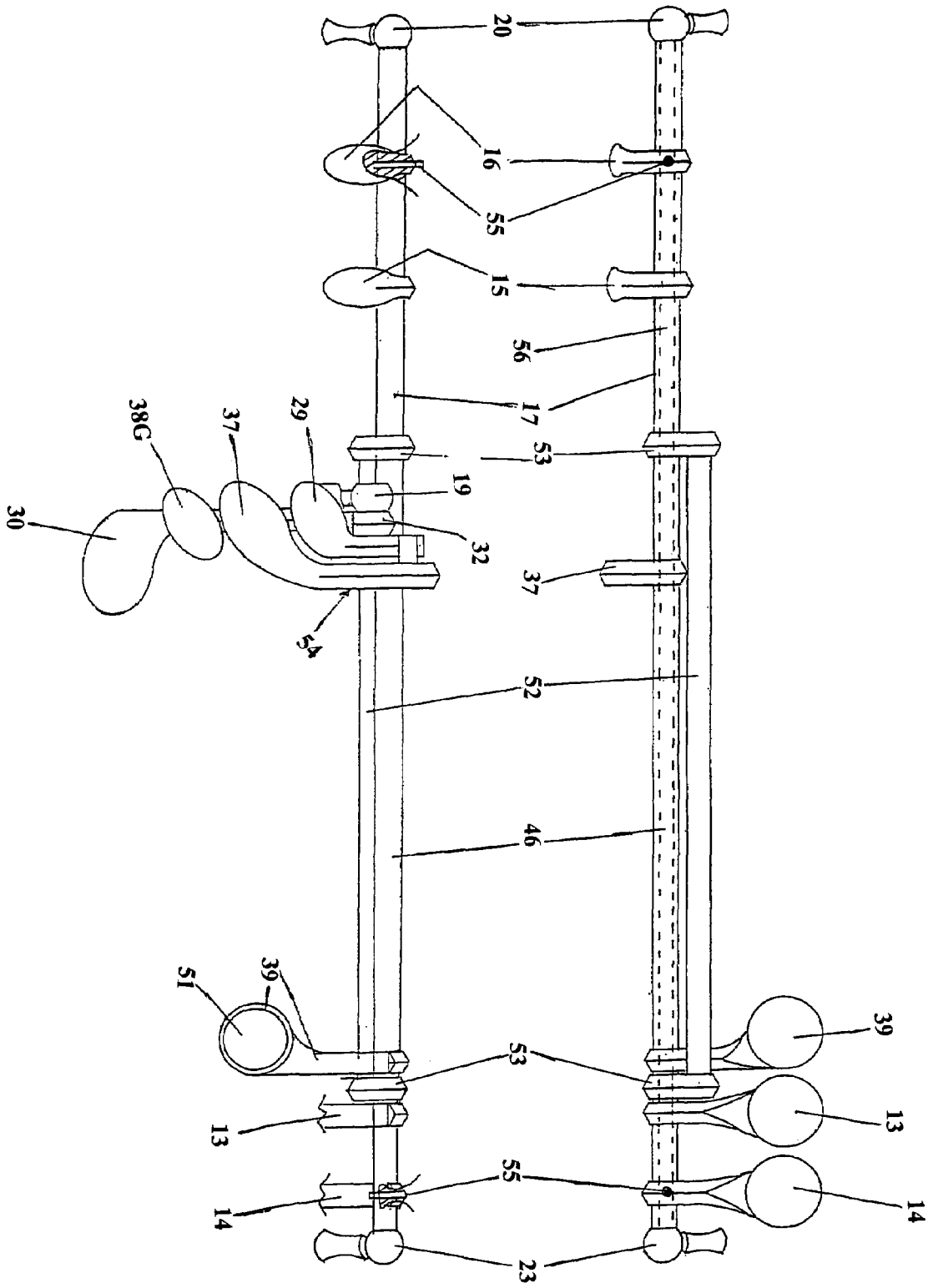
FIG. 10 is a view of a conical piccolo mechanism containing a C sharp trill key mounted on the D and D sharp trill axle further containing a G sharp trill touch piece and a D trill bridge.
Figure 11:
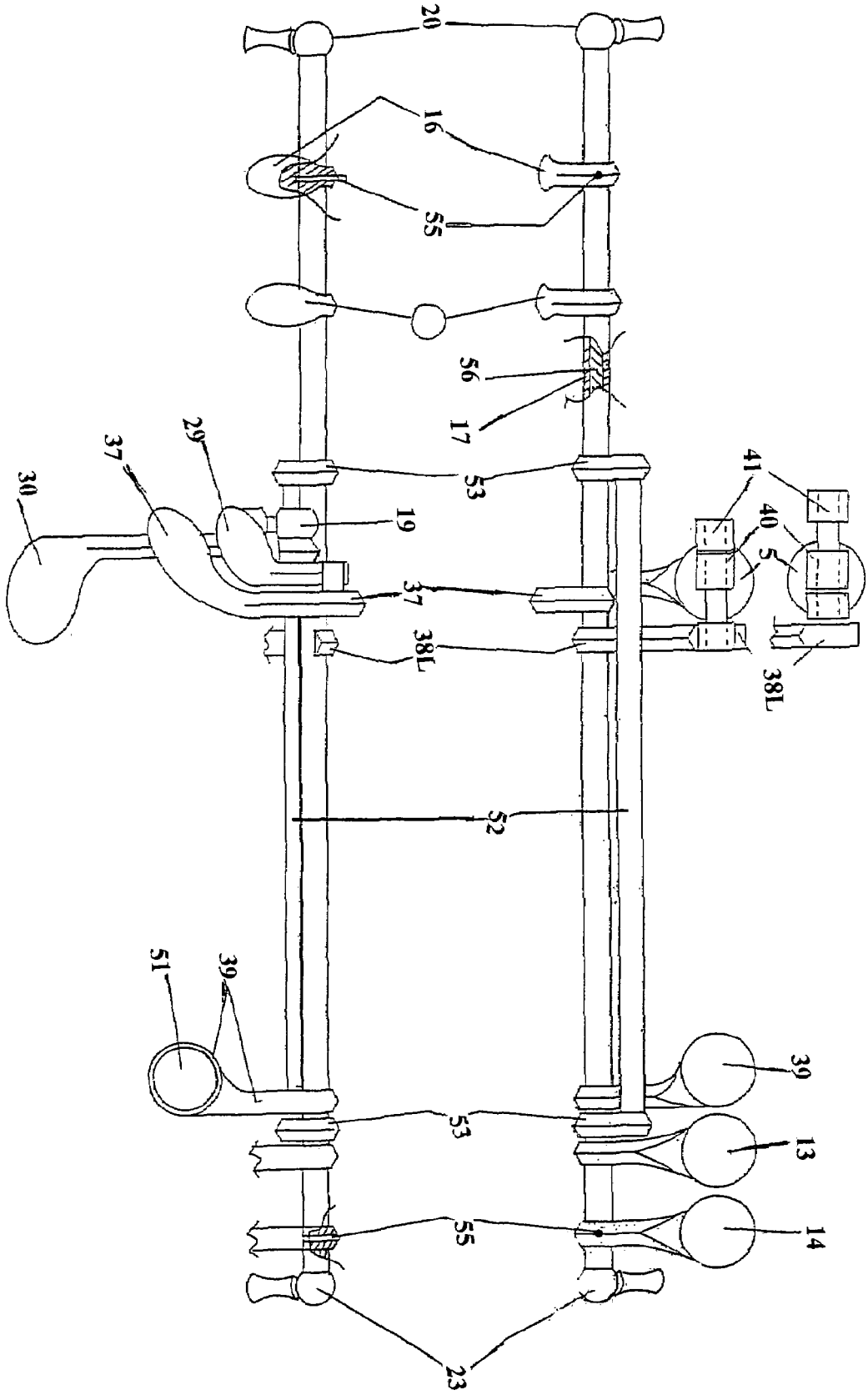
FIG. 11 is a view of a conical piccolo mechanism containing a C sharp trill key mounted on the D and D sharp trill axle further containing a G sharp trill link, a G sharp key barrel, a G sharp key pin and a D trill bridge.
Figure 12:
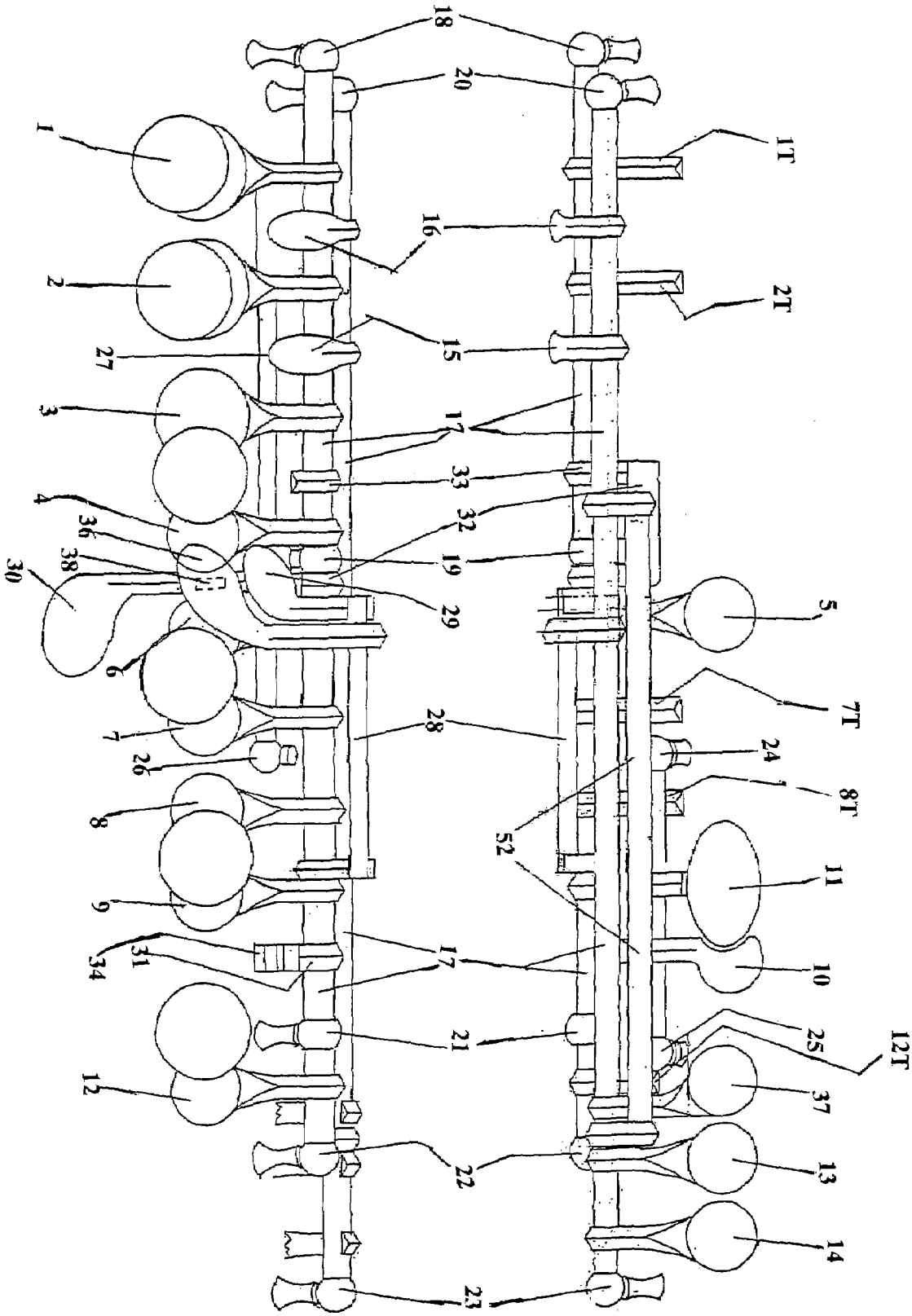
FIG. 12 is a view of a conical piccolo mechanism containing a C sharp trill key mounted on the D and D sharp trill axle further containing a C sharp trill boss and a D trill bridge.

FIGS. 8, 5 and 2 illustrate another embodiment of the subject invention. In this embodiment, a C sharp lever underside boss 42C is mounted under the C sharp trill lever 37 that contacts the G sharp lever 30. When the C sharp trill lever 37 is depressed, it contacts and depresses the G sharp lever 30, causing the G sharp key 5 to open.

FIGS. 9-12 illustrate additional embodiments of the subject invention. In these embodiments, the C sharp trill key 39 is not mounted on separate posts as it was in previous embodiments. However, the C sharp trill key 39 is mounted on the D/D sharp axle 56. Essentially, the C sharp trill key 39 is spliced into the tubing 17. The two parts of the D trill are then reconnected by means of a D trill bridge 52.

PUBLICATIONS

Harvard Dictionary of Music, (1972), 2nd Edition, Willi Apel, Harvard University Press, Cambridge, Mass.

*A Modern Guide to Flute Fingerings*, James J. Pellerite, Zalo Publications, Bloomington, Ind., L.C. No. 72-76260.

Flute Talk, December 1997, Morgan Williams, Piccolo Trill Fingerings.

*A Basic Guide to Fingerings for the Piccolo*, Stephen Tanzer, Sopranino Press, Bala Cynwyd, Pa., 1990 (Printed by Drexel Printing Company, Library of Congress Catalog Number 90-62716).

Website: www.sankyoflute.com

"The C sharp Trill" by Edward Johnson, leaflet distributed by Brannen Brothers, Flutemakers, Inc., Woburn, Mass.

*The Development of the Modern Flute*, Nancy Toff, University of Illinois Press, Urbana and Chicago, 1986, ISBN 0-252-01358-1.

*The Flute and Flute Playing*, Theobald Boehm, translation from German by Dayton C. Miller, Dover Publications, New York, 1964.

We claim:

1. An improved conical piccolo comprising:

an additional tone hole opening;

an axle;

means for attaching the axle to the conical piccolo; wherein the axle further comprises an external cover of tubing; wherein the tubing rotates around the axle;

a trill key attached at a first end to the tubing;

a trill key pad attached to a second end of the trill key; means for applying a first rotational force to the trill key wherein the trill key pad seals the additional tone hole opening; and, means for a user to apply a second rotational force wherein the trill key rotates on the tubing away from the additional tone opening wherein the trill key pad no longer seals the additional tone hole opening.

2. An improved conical piccolo comprising:

an additional tone hole opening;

a first post attached to the F sharp post;

a second post attached to the upper C sharp post;

an axle attached at a first end to the first post and attached at a second end to the second post;

wherein the axle further comprises an external cover of tubing, wherein the tubing rotates around the axle;

a trill key attached at a first end to the tubing proximal to the second post;

a trill key pad attached to a second end of the trill key;

a trill key tail attached at a first end to the tubing proximal to the second post;

a trill lever attached at a first end to the tubing proximal to the first post;

a spring catch attached to the tubing;

a wire spring attached at a first end to the second post and attached at a second end to the spring catch;

wherein the wire spring applies rotational force to the trill key and the spring catch in opposing directions wherein the trill key pad seals the additional tone hole opening; and, wherein depressing a second end of the trill lever rotates the tubing around the axle and opposes the rotational force applied to the trill key wherein the trill key rotates on the tubing away from the additional tone hole opening wherein the trill key pad no longer seals the tone hole opening.

3. The improved conical piccolo of claim 1 further comprising a trill touch piece mounted on a G sharp lever, wherein depressing the trill touch piece and the trill lever simultaneously unseals the additional tone hole opening and a G sharp key.

4. A method of playing the improved conical piccolo of claim 1 comprising using the first two fingers of a right hand of a user to depress the trill touch piece and the trill lever to simultaneously vent a C sharp trill tone hole opening, a D trill tone hole opening and a G sharp tone hole opening.

5. A method of manufacturing the improved conical piccolo of claim 1.

6. The improved conical piccolo of claim 1, wherein during a continuous play duration, a user can play all six standard trills of the flute by depressing keys of the piccolo.

7. The improved conical piccolo of claim 1, wherein a user can play a third octave G to A trill by trilling a set of fingers of one hand in the same direction of motion.

8. The improved conical piccolo of claim 1, wherein a third octave G to A trill is improved in clarity, repetition and intonation.

9. The improved conical piccolo of claim 2 further comprising a trill touch piece mounted on the G sharp lever, wherein depressing the trill touch piece and the trill lever simultaneously unseals the additional tone hole opening and the G sharp key.

10. A method of playing the improved conical piccolo of claim 2 comprising using a first and second two fingers of the right hand to depress the trill touch piece and the trill lever to simultaneously vent the C sharp trill tone hole opening, the D trill tone hole opening and the G sharp tone hole opening.

11. A method of manufacturing the improved conical piccolo of claim 2.

12. The improved conical piccolo of claim 2, wherein during a continuous play duration, a user can play all six standard trills of the flute by depressing keys of the piccolo.

13. The improved conical piccolo of claim 2, wherein a user plays the third octave G to A trill by trilling fingers of one hand and in the same direction of motion.

14. The improved conical piccolo of claim 2, wherein the third octave G to A trill is improved in clarity, repetition and intonation.

* * * * *